United States Patent [19]

Reynolds et al.

[11] Patent Number: 4,660,911

[45] Date of Patent: Apr. 28, 1987

[54] SURFACE MOUNT CONNECTOR

[75] Inventors: Charles E. Reynolds, Mechanicsburg; Robert N. Whiteman, Middletown, both of Pa.

[73] Assignee: AMP Incorporated, Harrisburg, Pa.

[21] Appl. No.: 806,141

[22] Filed: Dec. 6, 1985

[51] Int. Cl.[4] ..... H01R 9/09

[52] U.S. Cl. ..... 339/17 LC

[58] Field of Search ..... 339/17 LC, 17 LM, 17 L

[56] References Cited

U.S. PATENT DOCUMENTS

| | | | |
|---|---|---|---|
| 3,245,024 | 4/1966 | Evans | 339/17 LM |
| 3,493,916 | 2/1970 | Hansen | 339/17 LC |
| 3,697,933 | 10/1972 | Black et al. | 339/17 C |
| 4,425,015 | 1/1984 | Rizzo | 339/17 LC |
| 4,491,376 | 1/1985 | Gladd et al. | 339/17 LC |

*Primary Examiner*—Daniel C. Crane

*Attorney, Agent, or Firm*—F. Brice Faller; Bruce J. Wolstoncroft; David L. Smith

[57] ABSTRACT

Right angle surface mount connector comprises a housing loaded with stamped and formed contacts, each having a mating portion, a solder tail, and a bend therebetween. The rear face of the connector has a rib with side-by-side channels having V-shaped floors therein, a portion of each solder tail being disposed resiliently against a respective floor so that the tails are self-centering but can move laterally. The contact is retained in the housing by a scalloped plate adjacent the mating portion, a cantilever arm between the plate and the bend assuring compliance of solder tails against the circuit board.

10 Claims, 12 Drawing Figures

SURFACE MOUNT CONNECTOR

BACKGROUND OF THE INVENTION

The present invention relates to a connector for mounting to a printed circuit board and especially to a connector having contacts for soldering to the surface of the board.

U.S. Pat. No. 4,512,618 discloses a connector comprising a housing and a plurality of electrical contacts, the housing having a mating face, an opposed rear face, a mounting face perpendicular to the mating face and the rear face, and a plurality of contact receiving passages between the mating face and the rear face. Each contact has a mating portion, a solder tail substantially perpendicular thereto, and a bend therebetween, the mating portion being received in respective passage from the rear face, the solder tails being received in the rear face generally parallel thereto. The solder tails are received in channels in the rear face and extend beyond the mounting face for reception in plated through holes of a circuit board.

Recently, in the interests of facilitating automated placement and economy of circuit board manufactured, "surface mount" connectors have been developed. However, adapting a connector as described above by simply truncating the solder tails proximate the mounting face would present several problems. The solder tails must have a precise centerline spacing but should not be constrained against lateral movement relative to the housing, since different thermal expansion rates of the housing and the board could result in severe stressing of the solder joints if so constrained. Further, the solder tails should be axially compliant to accommodate for circuit board warpage.

SUMMARY OF THE INVENTION

According to the invention, a connector as described above is characterized in that the contacts have distal ends proximate the mounting face for disposition against the circuit board. The rear face of the housing has parallel generally V-shaped channels therein, a portion of each solder tail being disposed resiliently in a respective channel. The channel is wider than the portion therein, whereby the solder tails are self-centering in the channels but can move laterally.

DETAILED DESCRIPTION OF THE PREFERRED EMBODIMENT

Figure 1:
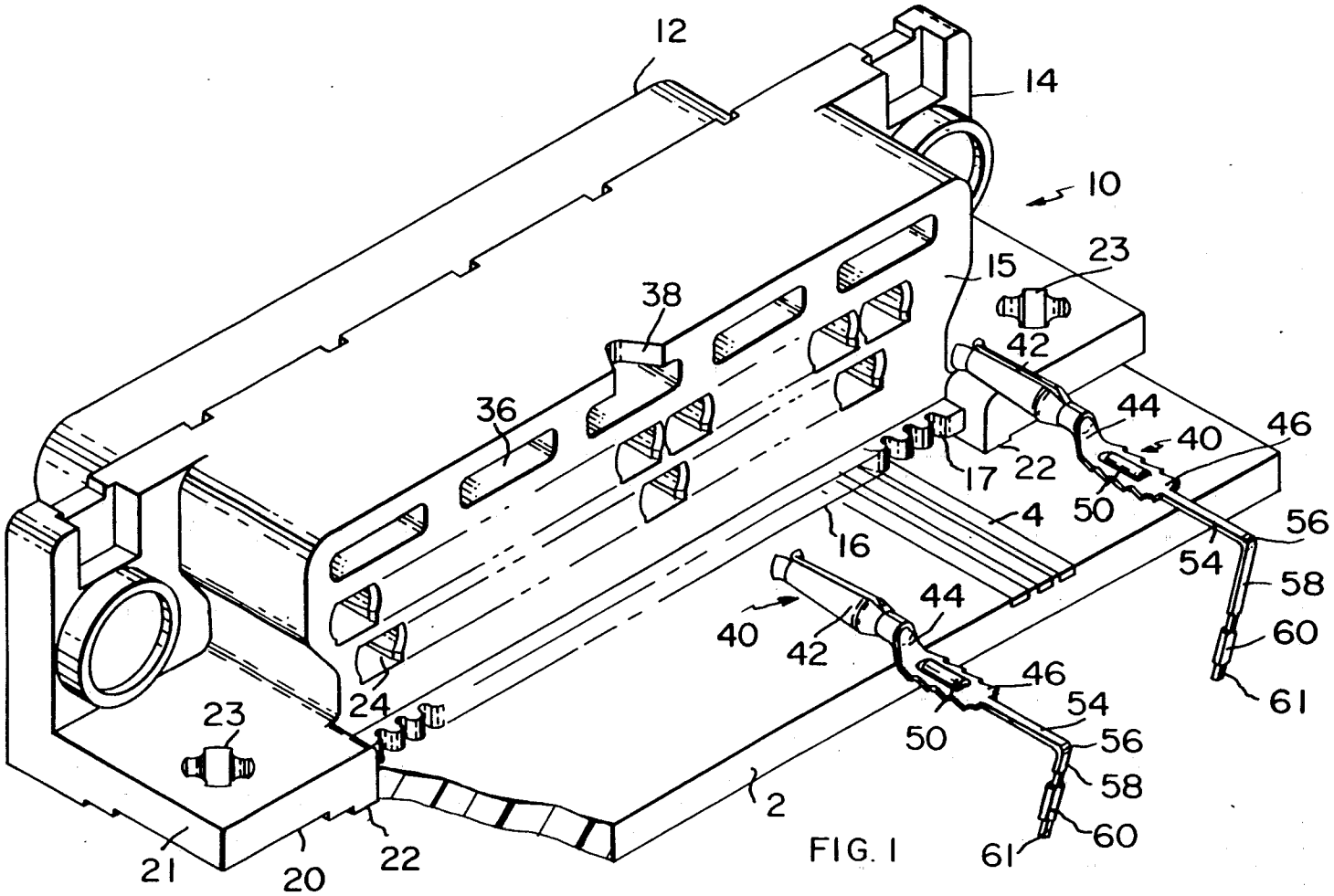
FIG. 1 is a perspective of the connector housing with contacts exploded therefrom.
Figure 3:
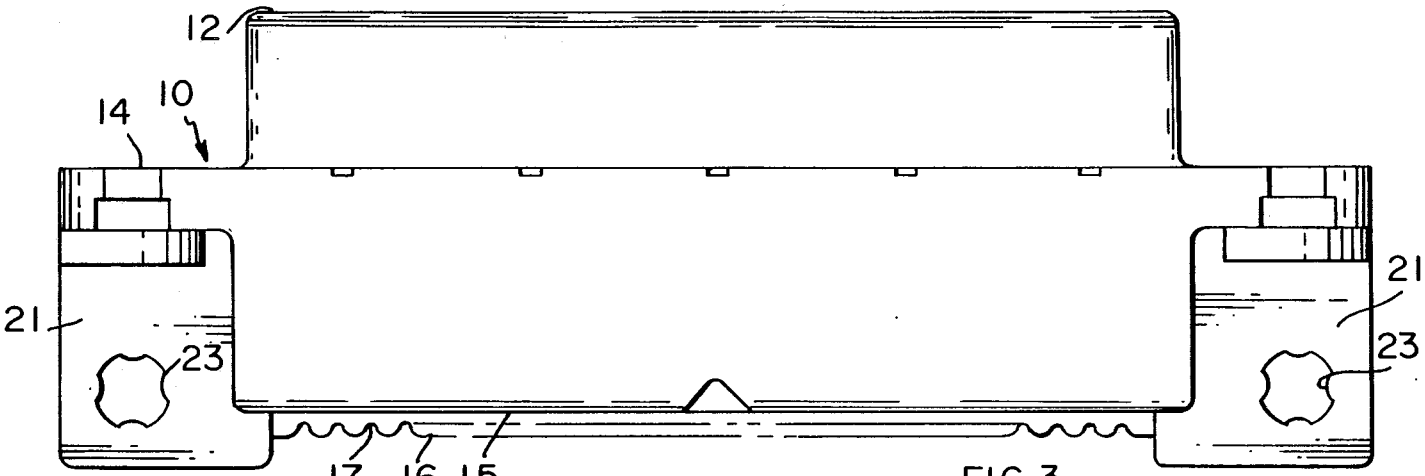
FIG. 3 is a plan view of the housing.

Referring to FIGS. 1 and 3, housing 10 has a mating face 12 surrounded by mating flange 14, an opposed rear face 15, and a mounting face 20 having stand-offs 22 which are secured to circuit board 2 by hardware received through holes 23 in mounting flanges 21. The holes 23 are profiled with bumps to snugly accommodate a rivet regardless of diameter variations within manufacturing tolerance, thus acting as a precision aligning feature. The housing 10 is injection molded of high temperature plastic with two parallel rows of contact receiving passages 24 extending between faces 12, 15. A rib 16 extends across the rear face 15 below passages 24, the rib 16 having channels 17 spaced the same distance apart as the centerline spacing of the passages 24. Core holes 36 conserve material and assure uniform cooling of the plastic after molding. Notch 38 facilitates robotic handling.

The stamped and formed metal contacts 40 each have a socket 42 and a retaining plate 45 which are received in a respective passage 24, the plate 46 being stepped down from socket 42 through neck 44. A hump 50 having a sheared rear surface 51 facilitates insertion. Behind the plate 46 a cantilever arm 54 extends to a band 56, which is formed through 105 degrees from the plane of the strip stock. A solder tail 58 extends from bend 56 to distal end 61 which is received against a solder pad on trace 4 on the board. The solder tails 58 of the contacts 40 received in the lower row of passages 24 are shorter than the solder tails of the contacts received in the upper row of passages. Each tail 58 is formed with a portion 60 of generally V-shaped cross section which is received in a respective channel 17.

Figure 2:
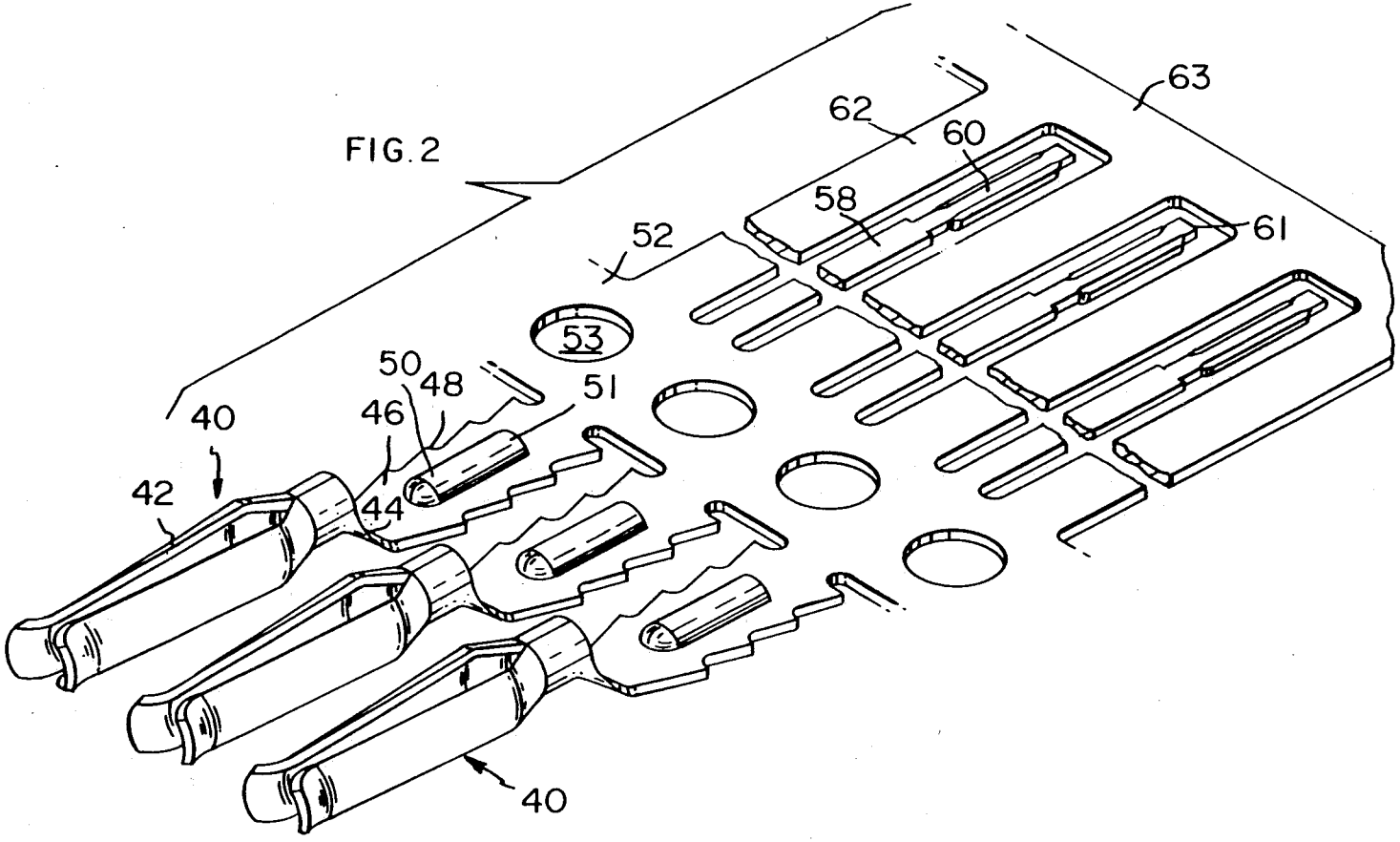
FIG. 2 is a perspective view of the contacts in strip form.

Referring also to FIG. 2, socket contacts 40 in strip form are advantageously stamped and formed on 0.109 inch centerline spacing according to the teaching of U.S. application Ser. No. 806,149 filed Dec. 6, 1985, the disclosure of which is hereby incorporated by reference. The carrier strip 52 is located intermediate opposite ends of the contact and has partitions 62 extending between solder tails 58 and attaching to tail strip 63 adjacent distal ends 61. This arrangement permits plating ends 61 but leaves them protected against damage during handling. The contact strip shown in intended for the upper row of passages 24; for the lower row, tails 58 would be shorter.

To assemble the contacts 40 into housing 10, a "comb" of contacts corresponding to the number of passages 24 in a row is severed from the continuous strip, and the tails 58 are formed through 105 degrees. The sockets 42 are then partially inserted en masse into the row of passages 24, and the carrier strip 52 is blanked off along shear lines between indexing holes 53. The sockets 42 are then fully inserted by pushing against the sheared rear surfaces 51 of humps 50, the sheared edge surfaces 48 of plate 46 being scalloped for retention. The procedure is then repeated for the other row of passages.

Figure 4B:
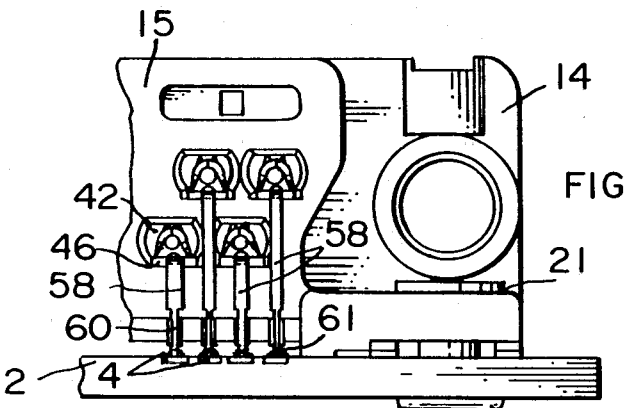
FIG. 4B is a rear view of the housing loaded with contcts and assembled to a printed circuit board.
Figure 4A:
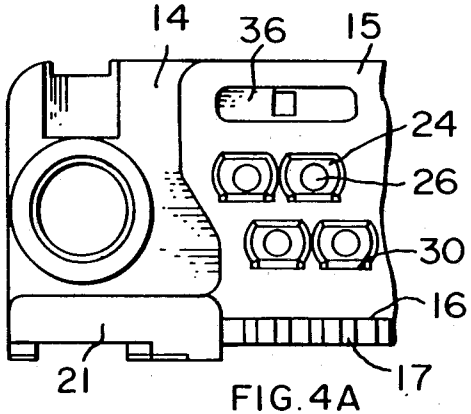
FIG. 4A is a rear view of the housing.
Figure 5A:
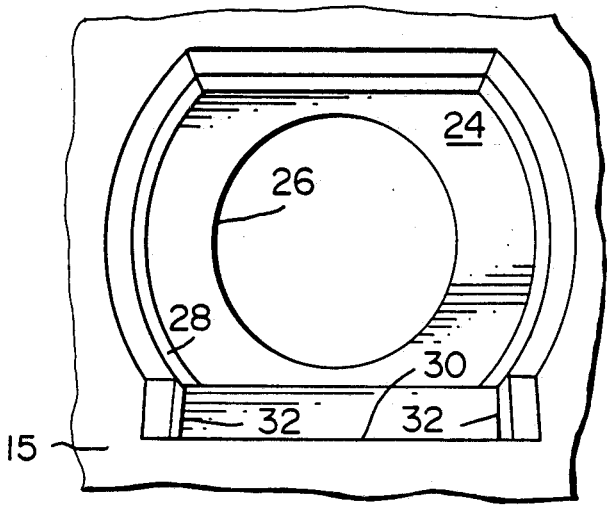
FIG. 5A is an enlarged rear view of a contact passage.
Figure 5B:
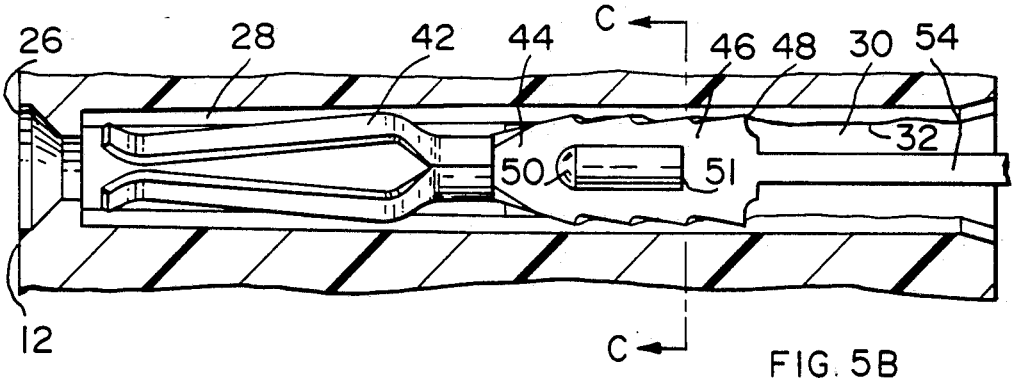
FIG. 5B is an enlarged plan section of the contact retention feature.
Figure 5C:
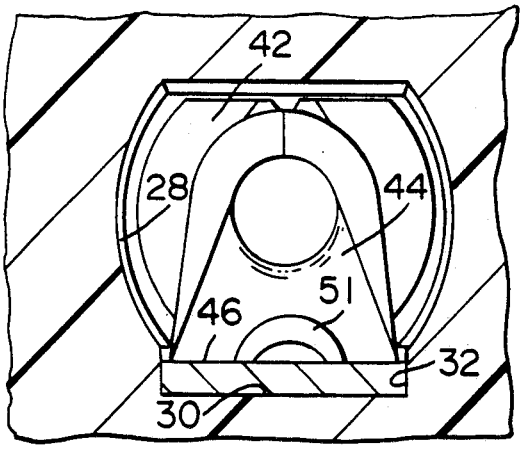
FIG. 5C is an enlarged rear section of the retention feature, taken along line C—C of FIG. 5B.

Referring to FIGS. 4A and 5A, each passage 24 consists of an upper portion 28 having arcuate sidewalls which converge toward pin receiving lead-in 26, and a subfloor 30 toward rear face 5, the subfloor 30 being flanked by sidewalls 32 which likewise converge, and have a dovetail profile to urge plate 46 against subfloor 30 (FIG. 5C). FIG. 4B shows contacts 40 assembled to housing 10, the V-shaped portions 60 on solder tails 58 being received in respective channels 17 at 0.055 inch centerline spacing, which corresponds to the spacing of traces 4 on board 2. Mounting hardware in the form of rivet 25 is used to fix the housing 10 to board 2 prior to soldering tails 58 to solder pads on traces 4.

FIGS. 5B and 5C show the socket 42 fully inserted in upper passage portion 28, the plate 46 being received flushly against subfloor 30 with scalloped edge surfaces 48 received in interference between sidewalls 32. The plastic conforms to the profile of edge surfaces 48 to prevent axial withdrawal and also flows onto the rolled surface of plate 46 to prevent upward movement.

Figure 6A:
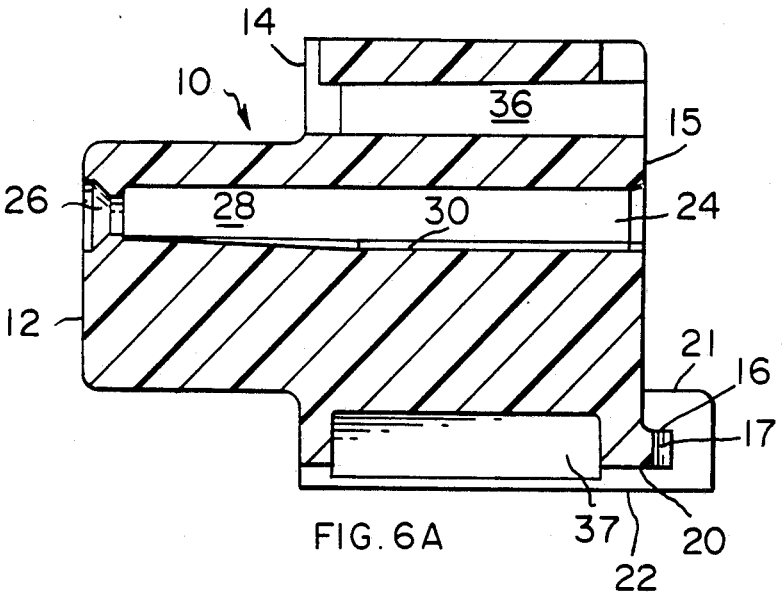
FIG. 6A is a side section of the housing.
Figure 6B:
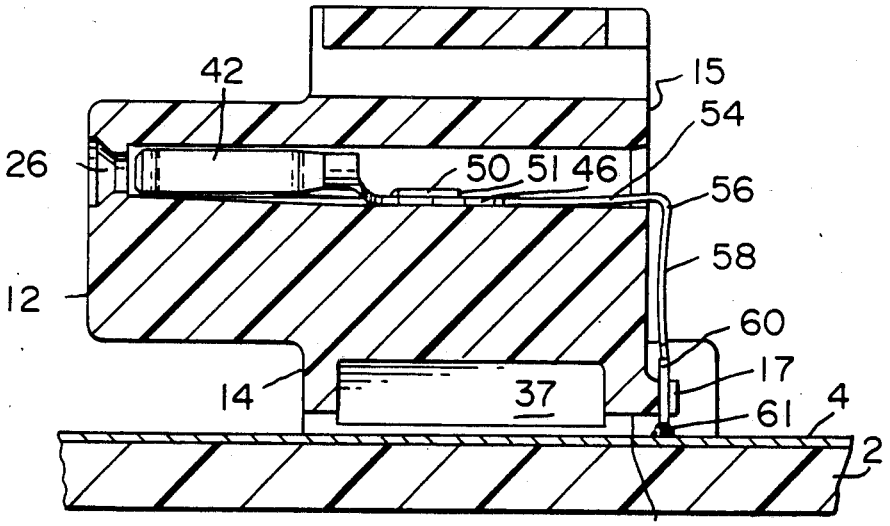
FIG. 6B is a side section of the housing loaded with terminals and assembled to a printed circuit board.

FIG. 6A and 6B are side sections corresponding to FIGS. 4A and 4B, taken through one of the passages 24 in the upper row. Bottom recess 37, like the cored passage 36, is provided to assure uniform cooling of the plastic after molding. Since the plate 46 is received between sidewalls 32 in interference, it provides the anchoring point for each cantilever arm 54 and thus permits upward bending to assure compliance of distal ends 61 with respective traces 4 on the printed circuit board. The rib 16 and channels 17 therein are located along the edge of mounting face 20. Since only stand-offs 22 on end flanges 31 separate the rib 61 from the board 2, this assures that distal ends 61 will be spaced as channels 17 and likewise as traces 4. At the same time, the stand-offs 22 allow room for solder joints formed by reflowing solder pads on the traces 4. The distal ends 61 are arranged in a single exposed row which can readily be soldered by radiant or other line-of-sight heat source, as well as vapor phase soldering. The single exposed row also permits inspection of the solder joints.

Figure 7B:
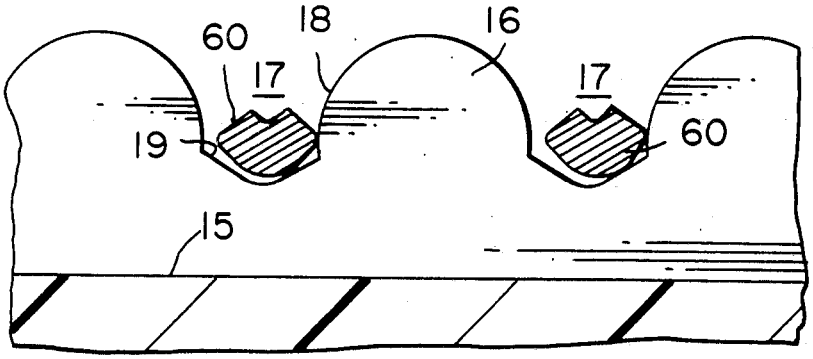
FIG. 7B is a partial plan section of the contact solder tails, stressed.
Figure 7A:
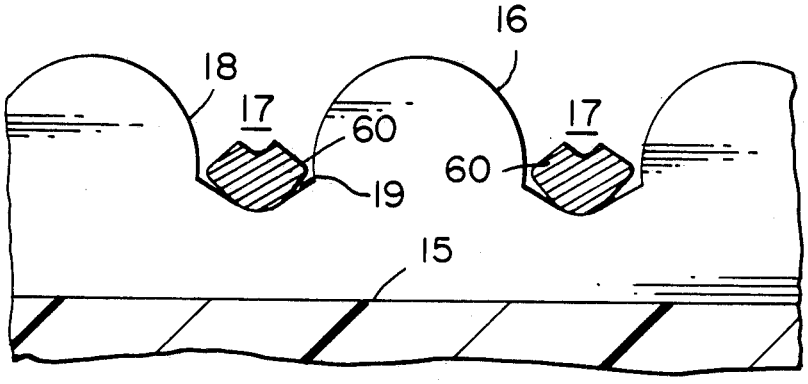
FIG. 7A is a partial plan section of the contact solder tails, unstressed.

FIG. 7A shows the self-aligning feature of the solder tail portions 60 in respective channels 17, which have generally V-shaped floors 19 between partitions 18. The 105 degree forming of bends 56 thus causes the solder tails 58 to deflect (FIG. 6B) so that each portion 60 seeks the center of the respective floor 19, and thus assures alignment of distal ends 61 with solder pads on board 2 when the housing is positively positioned by mounting hardware 25 (FIG. 4B). While the portion 60 is shown formed roughly to a V profile, coining or other removal of sharp corners facing floor 19 would also yield a profile readily permitting sliding movement.

Since the environment in which these connectors are used can become heated, the circuit board and connector housings therein are subject to expansion. Unfortunately, the expansion rates are not equal, each material having its own coefficient of thermal expansion. Referring to FIG. 4B, it will be apparent that the distal ends 61, being soldered to pads 4, will incur increased spacing as the printed circuit board 2 expands. Since the housing 10 expands at a different rate, this would impose severe stress on the solder joints if the portions 60 were constrained against lateral movement.

Referring to FIG. 7B, another major advantage of the invention is apparent; the portions 60 simply migrate laterally on respective floors 19 as temperature increases, thus saving the solder joints from stres levels which could break a joint.

The foregoing is exemplary and not intended to limit the scope of the claims which follow.

We claim:

1. A connector for mounting to a printed circuit board, comprising:

a housing having a mating face, an opposed rear face, a mounting fsce perpendicular to the mating face and the rear face, and a plurality of contact receiving passages between the mating face and the rear face;

a like plurality of electrical contacts, each having a mating portion, a solder tail substantially perpendicular thereto, and a bend therebetween, the mating portion being received in a respective passage from the rear face, the solder tails being received proximate the rear face and generally parallel thereto, the solder tails having distal ends proximate the mounting face for disposition against the circuit board;

a rib extending across the rear face of the housing having parallel channels with generally V-shaped configuration, a portion of each solder tail having an arcuate surface being disposed resiliently against a respective channel, the channels having a larger width than the solder tails, whereby the arcuate surfaces of the portions of the solder tails cooperate with the V-shaped channels to enable the solder tails to be self-centering in the channels, while still permitting lateral movement as required, thus saving the solder joints from stress levels which could break a joint.

2. A connector as in claim 1 wherein the bend of each contact forms an acute angle between the mating portion and the solder tail, the solder tail being disposed at a substantially right angle to the mating portion when the mating portion is retained in the passage, whereby the tails are disposed resiliently in the respective channels.

3. A connector as in claim 1 wherein the rib has a single row of parallel channels therein.

4. A connector as in claim 1 wherein the mating portions of the contacts lie in two parallel rows, the contacts in each row being spaced a first distance apart, the distal ends lying in a single row spaced at half said first distance.

5. A connector as claim 1 wherein each contact further comprises a retaining portion between said mating portion and said bend, said retaining portion being received in said passage in interference, said contact further comprising a cantilever portion between said retaining portion and said bend, said passage accommodating said arm to permit deflection away from said mounting face, whereby said distal ends may comply resiliently with said printed circuit board.

6. A connector as in claim 1 wherein the portion of each contact disposed in the respective channel is formed with a generally V-shaped cross-section.

7. A connector as in claim 1 wherein each contact is stamped and formed and further comprises a retaining plate having sheared edge surfaces received in said passage in interference, each plate being stamped with a hump to facilitate insertion.

8. A connector for mounting to a printed circuit board, comprising:

a housing having a mating face, an opposed rear face, a mounting face perpendicular to the mating face and the rear face, and a plurality of contact receiving passages between the mating face and the rear face, a like pluraity of electrical contacts, each having a mating portion, a tail portion substantially perpendicular thereto, and a band therebetween, the mating portion being received in a respective passage from the rear face, the tail portion being received proximate the rear face and generally parallel thereto, the tail portions having distal ends for electrical connection with conductive areas of the circuit board, a rib extending across the rear face of the housing having parallel channels, each channel being defined by opposed walls and a back surface, the opposed walls forming the channel width, each tail portion being disposed resiliently against a respective channel back surface, the channels having a larger width than the tail portions, whereby the tail portions cooperate with the channel back surface to enable the tail portions to be self-centering in the channels, while still permitting lateral movement of the tail portions in the channels as required.

9. A connector as in claim 8 wherein each tail portion has at least one arcuate surface disposed resiliently against the channel.

10. A connector as in claim 8 wherein each channel back surface has a generally arcuate configuration which cooperates with the tail portion.

* * * * *

UNITED STATES PATENT OFFICE

CERTIFICATE OF CORRECTION

Patent No. 4,660,911 Dated April 28, 1987

Inventor(s) Earl C. Myers, Jr.; James A. Paulo; Charles E. Reynolds; and Robert N. Whiteman, Jr.

It is certified that error appears in the above-identified patent and that said Letters Patent are hereby corrected as shown below:

Please list the inventors on the cover sheet of the patent as follows:

Inventors: Earl C. Myers, Jr., Harrisburg
James A. Paulo, Harrisburg
Charles E. Reynolds, Mechanicsburg
Robert N. Whiteman, Jr., Middletown
all of Pennsylvania.

Signed and Sealed this

Twenty-seventh Day of December, 1988

*Attest:*

DONALD J. QUIGG

*Attesting Officer*

*Commissioner of Patents and Trademarks*